US008274019B2

(12) United States Patent
Morin et al.

(10) Patent No.: US 8,274,019 B2
(45) Date of Patent: Sep. 25, 2012

(54) HIGH TEMPERATURE CONNECTOR AND METHOD FOR MANUFACTURING

(75) Inventors: Philip K Morin, Bristol, CT (US); Stanley G Tomalesky, Plantsville, CT (US)

(73) Assignee: Carbon Fibers Heating Technologies, LLC, Forestville, CT (US)

( * ) Notice: Subject to any disclaimer, the term of this patent is extended or adjusted under 35 U.S.C. 154(b) by 262 days.

(21) Appl. No.: 12/761,614

(22) Filed: Apr. 16, 2010

(65) Prior Publication Data

US 2011/0253701 A1 Oct. 20, 2011

(51) Int. Cl.
*H05B 1/00* (2006.01)

(52) U.S. Cl. ..... 219/482; 29/428

(58) Field of Classification Search ..... 219/482; 29/428

See application file for complete search history.

(56) References Cited

U.S. PATENT DOCUMENTS

| | | | | |
|---|---|---|---|---|
| 5,323,214 | A * | 6/1994 | Kai | 399/289 |
| 2005/0184051 | A1* | 8/2005 | Johnston | 219/538 |
| 2008/0182461 | A1* | 7/2008 | Johnston | 439/874 |

* cited by examiner

*Primary Examiner* — Hoai V Ho

(74) *Attorney, Agent, or Firm* — Joseph R. Carvalko, Jr.

(57) ABSTRACT

This invention generally relates to a connector for attaching an electrical power source to a conductive fiber tow comprising: a flat surface having an upper and a lower mating portion substantially opposing each other; said upper portion includes a plurality of parallel ribbed troughs and said lower portion includes plurality of parallel ribbed protrusions wherein the upper and lower portions of said surface engagingly fasten a portion of said fiber tow between the ribbed protrusions and the ribbed troughs to hold the said fiber in a fixed position; and at least one electrical contact integral to the flat surface to supply electrical energy to said fiber for producing heat energy.

19 Claims, 8 Drawing Sheets

(a)

(b)

SECTION A-A (a)

(b)

HIGH TEMPERATURE CONNECTOR AND METHOD FOR MANUFACTURING

FIELD OF THE INVENTION

The present invention relates to a connector for fixing in position a flat conductive tow and for connecting the tow to an electrical energy source.

BACKGROUND OF THE INVENTION

Heating elements have wide applications in the construction, consumer and industrial sectors of the economy. Flat, longitudinally extended heating elements can be comprised of wire filaments or carbon fiber tows. Their physical characteristics such as thickness, shape, size, strength, flexibility and other features affect their applicability. Numerous types of thin and flexible heating elements have been proposed, for example U.S. Pat. Nos. 4,764,665 and 7,247,822. The '822 patent discloses a heating element assembly that uses a carbon fiber wherein the fibers are sandwiched between two layers of an "amorphous" polyester film. The heater element operates below 250.degree F. The technologies, such as the polyester film or the termination connector used in the creation of heating element products often limit the maximum operating temperatures before degradation, reliability, product life cycle and serviceability are affected. U.S. Pat. No. 7,662,002 discloses an assembly for connecting a tow of axially elongated carbon fibers with a plurality of discrete contact portions, referred to as a tow into a metal "U" shaped trough with knurled ridges. Manufacturing this type of connector requires pressing down a top male die with ridges to squeeze the carbon fiber layers and then uses ultrasonic welding to fix the fibers to contact points. A pneumatically activated carriage mechanism applies pressure to the preassembled parts. The '002 processes uses a 1000 watt ultrasonic welder producing a 20 kHz frequency and a long weld time of 600 milliseconds at 60 joules of energy.

The heating elements of the prior art have several problems that limit their usability. The first problem arises because the ultrasonic energy causes the carbon fibers to vibrate and some portion of them migrate beyond the sides of the polyester film causing shorts to ground when voltage is applied. The method of manufacture utilizing ultrasonic welding also slows down the manufacturing of the assembly. Additionally ultrasonic welding of carbon fibers to metal is unreliable when the connector temperature exceeds a temperature of 400F. For flat heating elements utilizing carbon fiber tows contained in a polyester sheath the temperatures cannot exceed a temperature of 350F. before the connector itself and the polyester suffer permanent damage. As will be described below, a novel sheathing material insofar as heater applications are concerned allows the temperature of the carbon fiber tow to exceed a temperature of 700F. and therefore the connector utilizing ultrasonic welding is unsuitable. Once the fibers are welded to the connector they become an integral part of the fiber tow preventing a complete substitution of the entire assembly in the event there is a malfunction in the field. What is needed is a connector that does not depend on ultrasonic welding and that is easily replaced in the field with out a complete replacement of the tow.

SUMMARY OF THE INVENTION

This invention generally relates to a connector for attaching an electrical power source to a conductive fiber tow including a flat surface having an upper and a lower mating portion substantially opposing each other; said upper portion includes a plurality of parallel ribbed troughs and said lower portion includes plurality of parallel ribbed protrusions wherein the upper and lower portions of said surface engagingly fasten a portion of said fiber tow between the ribbed protrusions and the ribbed troughs to hold the said fiber in a fixed position.

An embodiment of the invention further relates to a method of assembling a connector for attaching an electrical power source to the conductive carbon fiber tow including forming the substantially rectangular metal plate having surface and having the lower surface and an upper surface; forming on a left half portion of said plate lower surface the plurality of troughs and forming on a right half portion of said plate lower surface the plurality of ribbed protrusions; bending said plate at substantially the mid section between the left half portion and the right half portion substantially 180 degrees to create opposing mating portions wherein the plurality of troughs are directly opposed to the plurality of ribbed protrusions.

An embodiment of the invention further relates to a heating element utilizing the carbon fiber tow and the connector that includes the opposing upper portion and lower portion wherein said upper portion includes a plurality of parallel ribbed troughs and said lower portion includes plurality of parallel ribbed protrusions wherein the upper and lower portions of said surface engagingly fasten that portion of said tow between the ribbed protrusions and the ribbed troughs to hold the fiber tow in a fixed position, and wherein the carbon fiber tow is embedded in a sheath comprised of a laminar silicon rubber material.

DESCRIPTION OF PREFERRED EMBODIMENT

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1A:
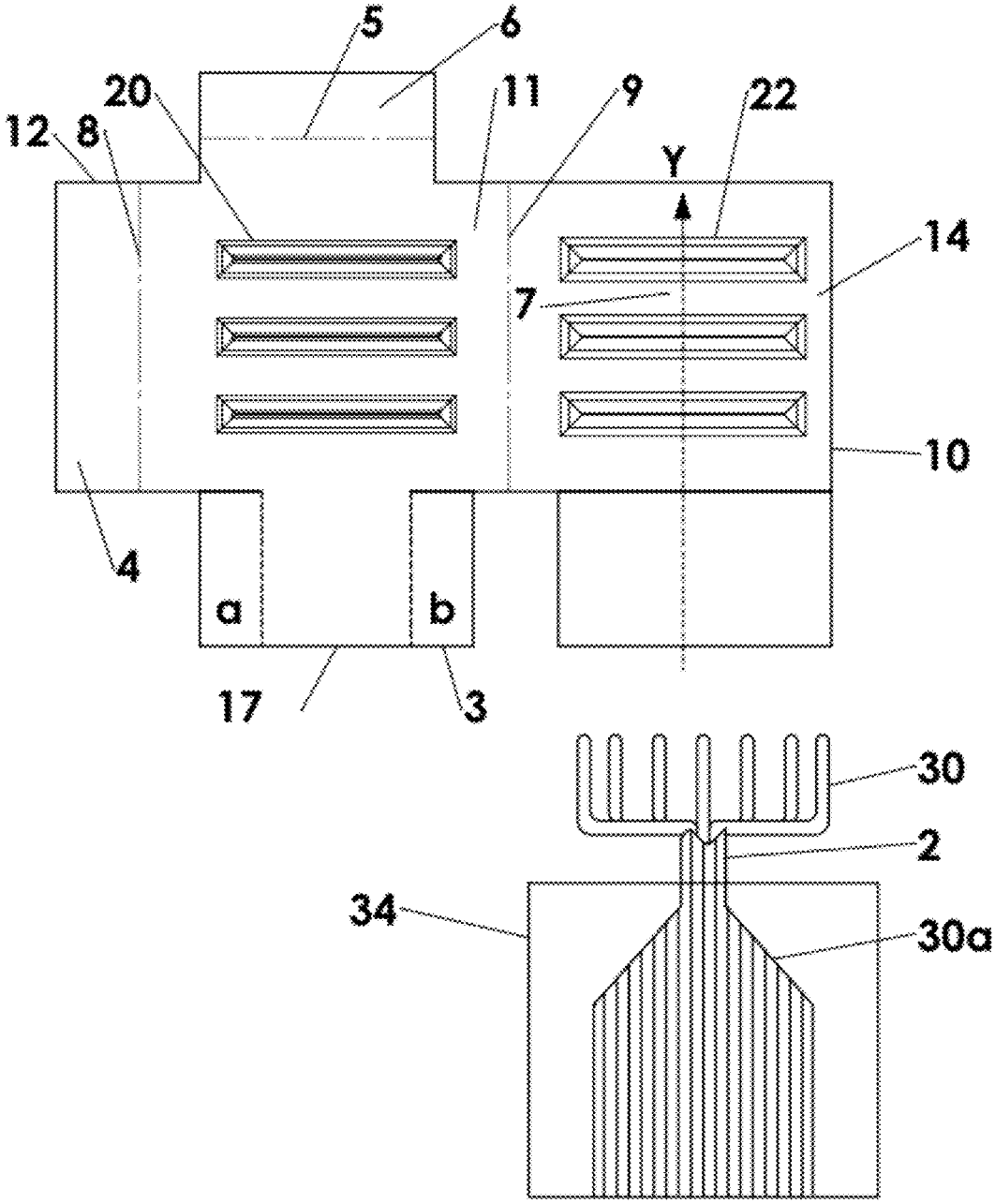
FIG. 1*a* illustrates a plan view of a surface of a plate with upper and lower opposing mating portions including a tow bundle in accordance with an embodiment of the present invention.

Referring to FIG. 1*a*, the invention is practiced with the electrically insulated carbon fiber tow 30*a* having from about 1,000 to about 100,000 generally cylindrical carbon filaments or fiber strands each having a diameter ranging from 6 to 10 microns and an electrical resistant at ambient temperature 75F. in the range of 2 to 3 ohms per linear foot, plus or minus 0.10 ohm. The flexible carbon strands, which comprise the tow 30*a* are of indeterminate length and are disposed in generally side-by-side parallel relation to each other. Prior to termination, the carbon fiber tow 30*a* are disposed within a single bundle having a substantially flat, generally oval or elliptical cross section throughout its entire length, as more fully illustrated in cross section in FIG. 7*b*.

As shown in FIG. 1*a*, one embodiment of the invention is a connector 10 for attaching an electrical power source to a conductive fiber tow 30*a*. The connector is constructed from a flat metal place having a surface 11 that when properly formed will have an upper internal surface 12 and a lower internal surface 14, each surface referred to as a mating portion substantially opposing each other; said upper portion includes a plurality of parallel ribbed troughs 20 and said lower portion includes plurality of parallel ribbed protrusions 22, such that the upper and lower portions of said surface engagingly fasten a portion of said fiber tow 30*a* between the ribbed protrusions 22 and the ribbed troughs 20 to hold a solid bundle in a fixed position of divisional set of fibers as in FIG. 1*a*, 30 as in, or laying flat as in FIG. 1*b*, 30.

Figure 1B:
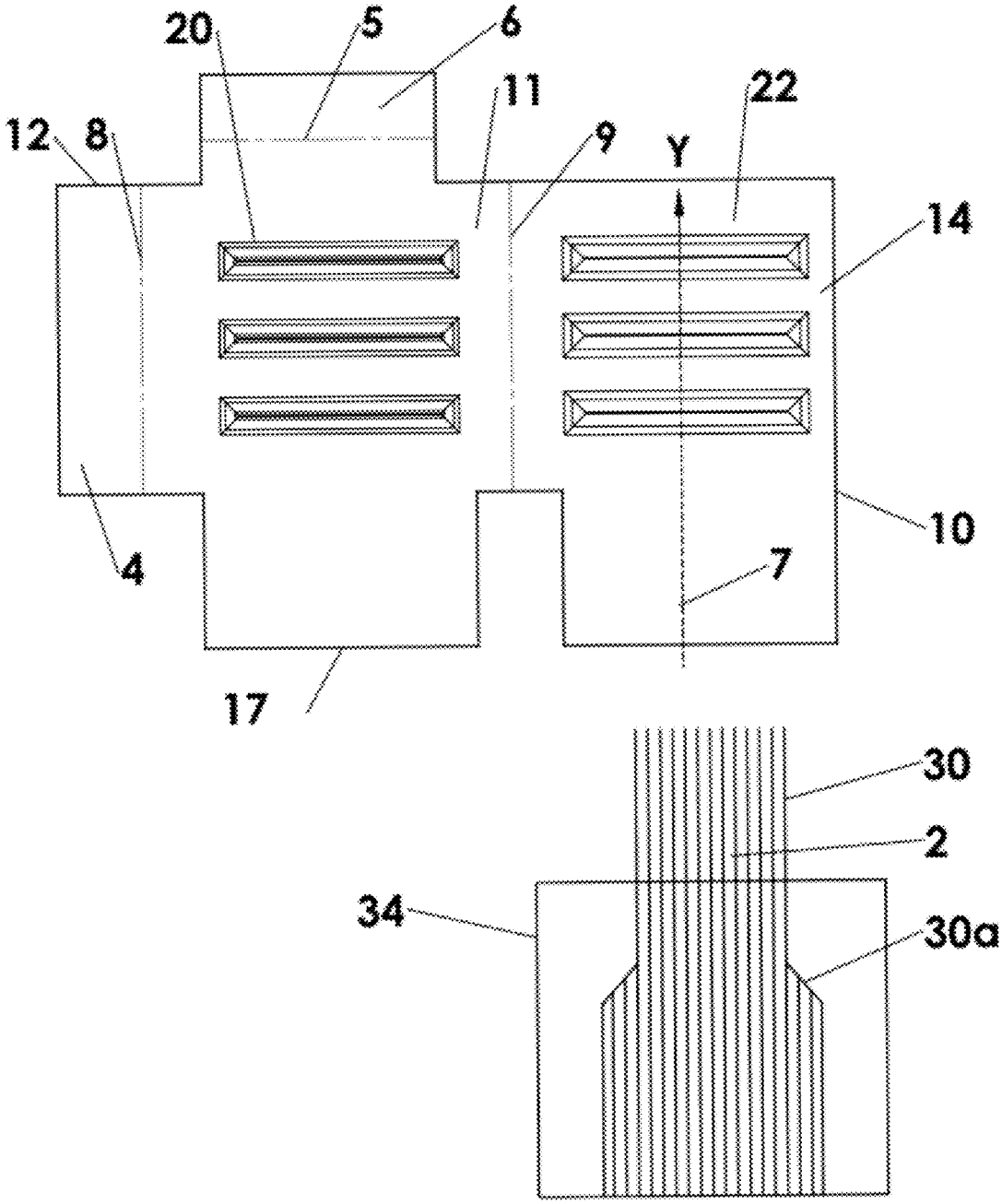
FIG. 1*b* illustrates a plan view of a surface of a plate with upper and lower opposing mating portions including a tow bundle in accordance with an embodiment of the present invention.

Turning to the drawings and referring first particularly to FIG. 1*a* and FIG. 1*b* each illustrates a surface 11 flat metal plate that will be bent into opposing mating portions described by upper internal surface 12 and lower internal surface 14 including a upper portion having a plurality of parallel ribbed troughs 20 and lower portion having a plurality of parallel ribbed protrusions 22. A heating element 34 composed of a carbon fiber tow 30*a* attaches through the divisional set of fibers 30 to the connector 10 indicated generally by the reference to the dotted line designated 7. In FIG. 1*a* and FIG. 1*b* the termination of the set of carbon fibers 30 are laid over the parallel ribbed protrusions 22. Optionally in FIG. 1*a* the termination of the set of fibers 30 are laid over the parallel ribbed troughs 20. Turning to FIG. 1*a*, in the event the termination of the divisional set of fibers 30 are laid over the parallel ribbed protrusions 22 then the surface 12 is folded over at the bend 9 to bring the parallel ribbed troughs 20 over the parallel ribbed protrusions 22 forming the two opposing mating portions 12, 14 as further illustrated in FIG. 2*a* and FIG. 2*b*. Turning to FIG. lb, alternatively, in the event the termination of the set of fibers 30 are laid over the parallel ribbed troughs 20 then the surface 14 is folded over at the bend 9 to bring the parallel ribbed troughs 20 over the parallel ribbed protrusions 22 forming the two opposing mating portions 12, 14 as illustrated in FIG. 2*a* and FIG. 2*b*.

Referring to FIG. 1*a* and FIG. 2*a* bending at mid section bend 9 produces a rolled edge 16 when the bend approaches 180 degrees and thereafter a pressure applied to the top of the external surface 13 essentially closes, clam shell-like, on the divisional set of set of fibers 30 holding them in place as will be further described in connection with FIG. 3. A clip 24 contacts surface 15 in area 28 to retain the mating surfaces in an opposed closed position and maintain a pressure on divisional set of fibers 30 now in the grip of the parallel ribbed protrusions 22 and the associated ribbed troughs 20.

Figure 2:
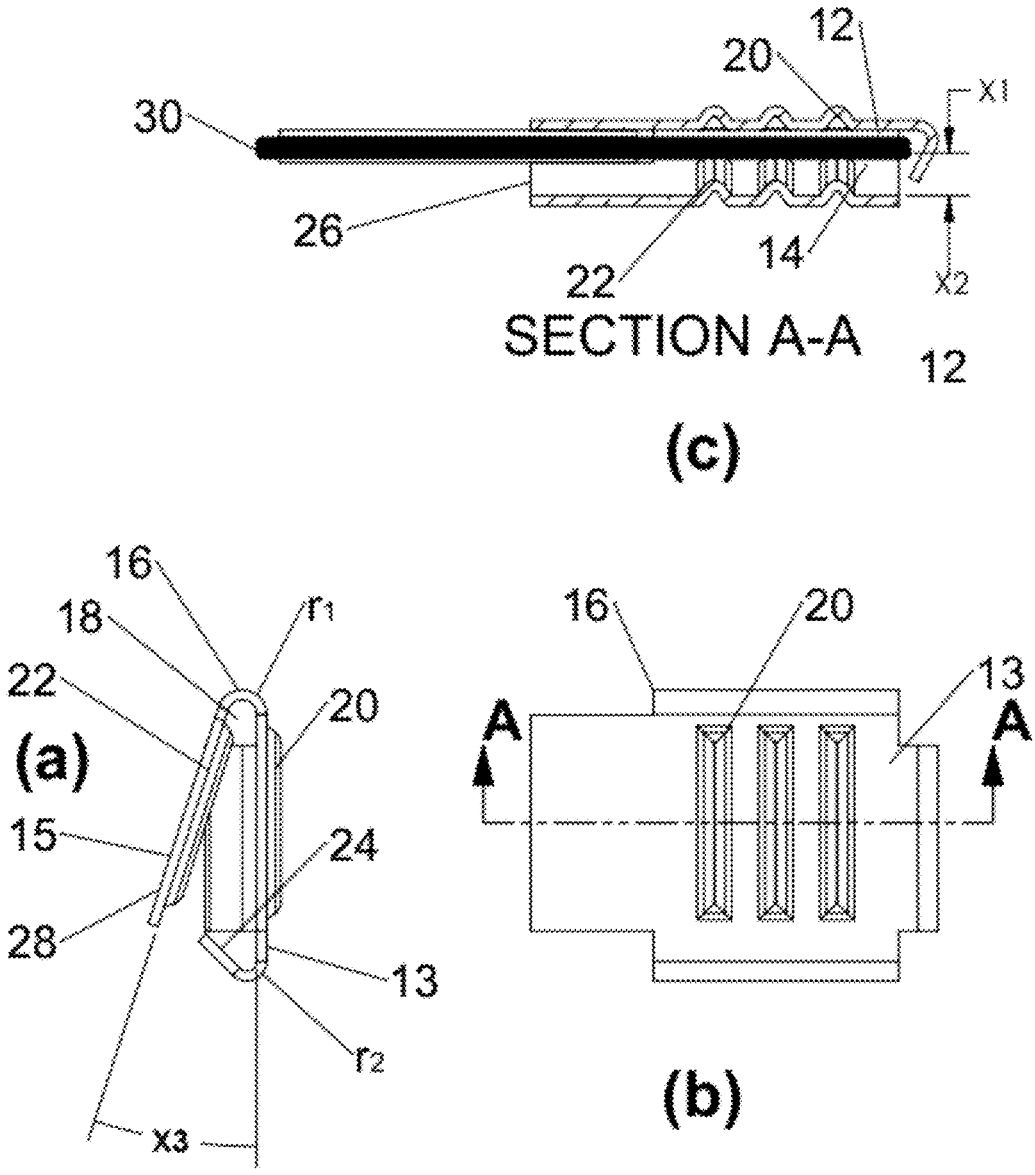
FIG. 2*a* illustrates a left view of a connector in accordance with an embodiment of the present invention.
FIG. 2*b* illustrates a right top view of a connector in accordance with an embodiment of the present invention.
FIG. 2*c* illustrates a cross sectional view of a connector in accordance with an embodiment of the present invention
Figure 3:
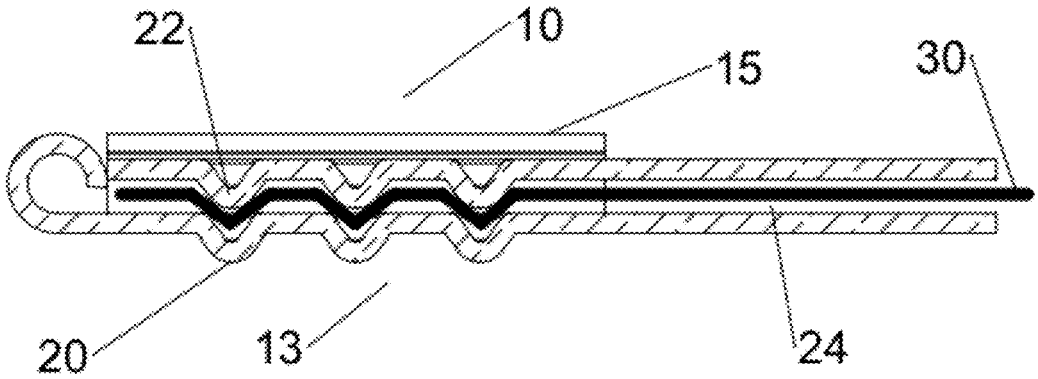
FIG. 3*a* illustrates a cross sectional view of a connector in accordance with an embodiment of the present invention.
FIG. 3*b* illustrates a cross sectional view of a connector in accordance with an embodiment of the present invention.
Figure 3:
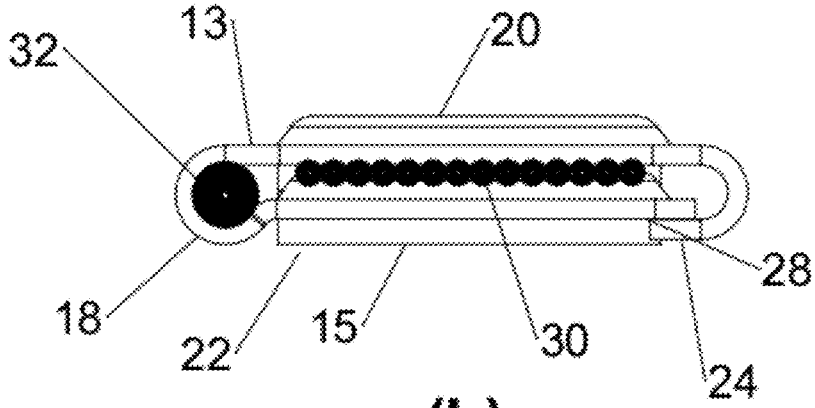

With reference to FIG. 1*a* and FIG. 2, bend 8 forms hem 4 into clip 24. The clip 24 mates to surface 15 in area 28 to firmly bring together and grip of the connector 10 surfaces 13,15 and thus add pressure to the carbon fiber 30 when in tow channel 26 (FIG. 2*c*) and held thereon between the respective ribbed troughs 20 and the associated parallel ribbed protrusions 22 in accordance with an embodiment of the present invention.

Referring to FIG. 1*a*, FIG. 2*a* and FIG. 3*b* channel 18 is formed when the mid section bend 9 forms surface 11 into to opposing mating surfaces 12, 14. The channel 18 permits running a wire 32 to an electrical energy source (not shown). The wire 32 is fixed in place in channel 18 when mid section bend 9 depicted by the dotted line forms the rolled edge 16. Referring to FIG. 1*a* again, another embodiment uses bend 5 hem 6 to form channel 19, which also permits running wire 32 to an electrical energy source (not shown). The hem 6 can be replaced with a bayonet style section and the connection can be made with a standard female insulated connector (not shown).

Figure 6:
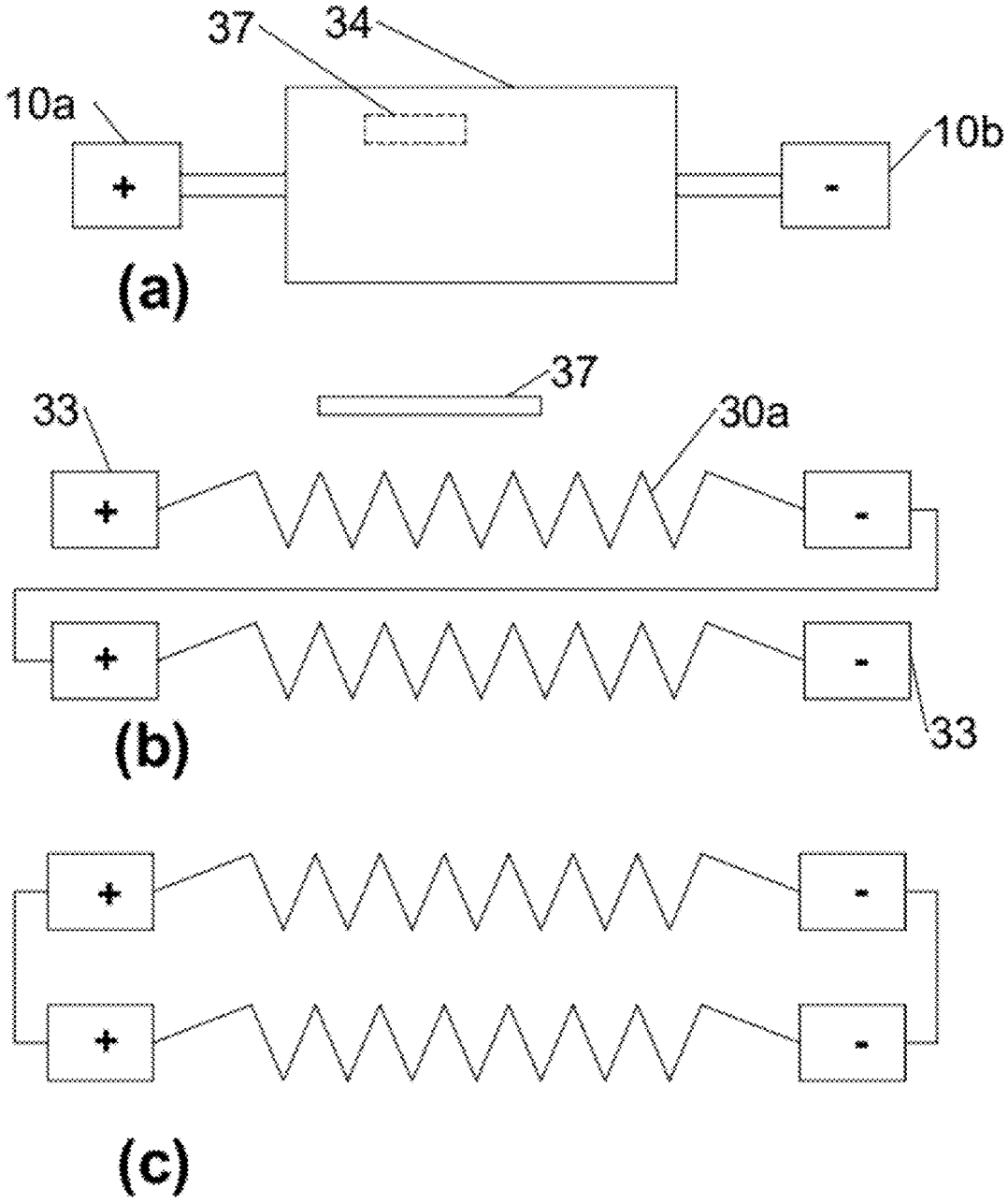
FIG. 6*a* illustrates a plan view of the heater assembly in accordance with an embodiment of the present invention.
FIG. 6*b* illustrates an electrical schematic of two heater assemblies connected in series in accordance with an embodiment of the present invention.
FIG. 6*c* illustrates an electrical schematic of two heater assemblies connected in parallel in accordance with an embodiment of the present invention.

FIG. 6*a* sectional view A-A illustrates the fibers firmly in the grip of the connector 10 parallel ribbed protrusions 22 and the associated ribbed troughs 20 in accordance with an embodiment of the present invention. FIG. 3*b* also illustrates the carbon fibers 30 firmly in the grip of the connector 10 parallel ribbed protrusions 22 and the associated ribbed troughs 20.

Figure 4:
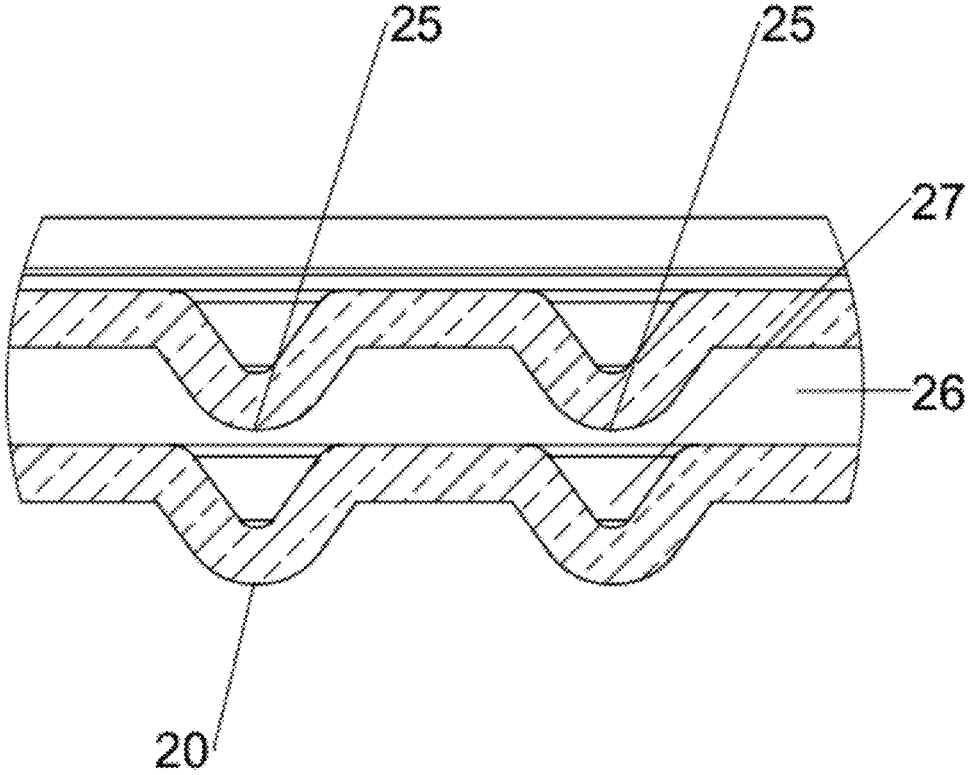
FIG. 4 illustrates a cross sectional view of a connector in accordance with an embodiment of the present invention.

FIG. 3*a* and FIG. 4 show cross sections of the parallel ribbed protrusions 22 and the associated ribbed troughs 20. The tips of the protrusions 22 have contact surface 25 with a generous radius that assures that the divisional set of carbon fiber strands 30 are not cut when griped in the tow channel 26. The recess of the ribbed troughs 20 have contact surface 27 with a generous radius that also insures that the strands of carbon fiber 30 are not cut when griped in the tow channel 26 in the process of applying pressure to the top surface of connector 10. Similarly, by using a common practice of deburring by tumbling the connector 10 in a tumbling barrel along with tumbling media for specific metals, any sharp edges on the metal edges or surfaces are smoothed thus preventing breakage of the divisional set of carbon fiber 30 strands caused by sharp corners of the connector 10.

Figure 5:
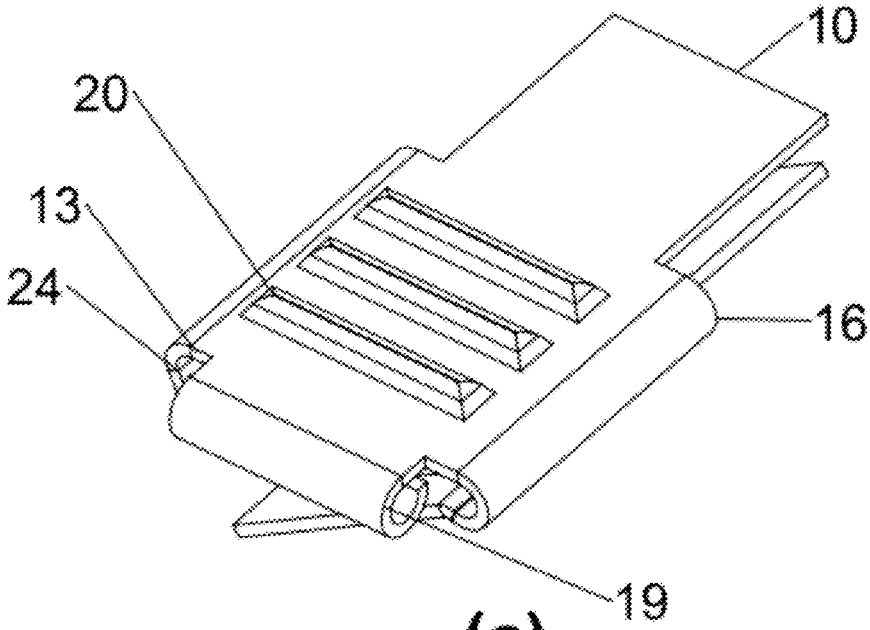
FIG. 5*a* illustrates a perspective view of a connector in accordance with an embodiment of the present invention.
FIG. 5*b* illustrates a perspective view of a connector in accordance with an embodiment of the present invention.
Figure 5:
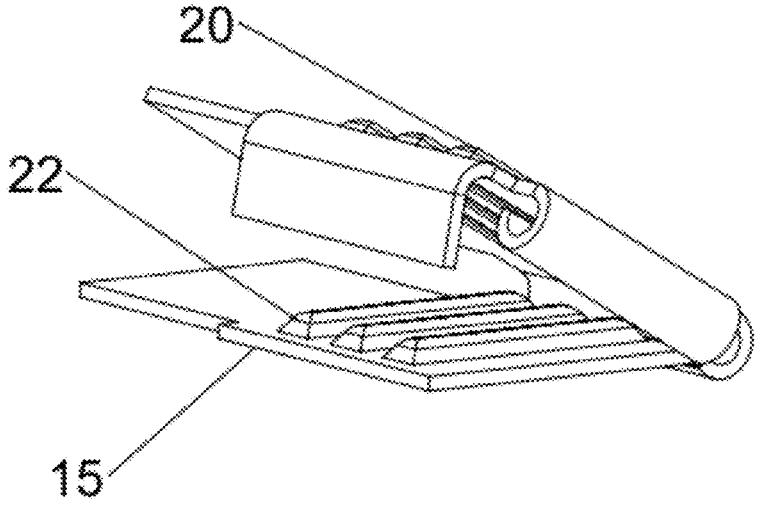

FIG. 5*a* and FIG. 5*b*, show a perspective view of connector 10. The connector 10 may be manufactured from any metal, engineered material or plastic suitably for withstanding the operating temperature of the connector. A metal connector 10 material has the added feature that they may additionally act as heat sink for the heat generated by the heater 34 (FIG. 1*a*). This may have applications when it is desirable to bleed off heat from the heater 34 when power is removed from the carbon fiber tow 30*a*. If the connector 10 is manufactured from an insulating material, such as plastic then an additional conductive element must be installed that insures an electrical connection between the carbon fibers 30 and the channel 18 wire 32 connection to the power source. An additional conductive element may consist of a flash metallic coating or metallic foil lamination of a conductive material applied to the internal surfaces 12, 14 including the surfaces that comprise the ribbed trough 20 and rib protrusion 22.

Again referring to FIG. 1*a* and FIG. 2*a*, as the upper surface 13 and the lower surface 15 are pressed together and the opposing hem 4 is folded over the lower surface to form clip 24, the divisional set of carbon fiber 30 conforms to the shape of a serpentine layer as it falls and rises over the protrusions 22. A full metal construction for the plate having surface 11 has the advantage of a high electrical contact ratio between the fibers 30 and the wire 32. That is, more of the divisional set of carbon fiber 30 is exposed to the metal surfaces.

Referring again to FIG. 5*a* and FIG. 5*b*, the assembled the connector 10 may have applied to its external surfaces 13, 15 an electrical insulation material or it may be treated as for example by anodizing for electrical insulation to prevent the connector 10 outer surfaces to come into contact with ground or other voltage potentials. Silicon paint is a preferred method, however, by way of further example and not limitation aluminum anodizing and electrochemical process by which aluminum is converted into aluminum oxide on the surface of a part may among other benefits provide electrical insulation.

In addition to an electrical insulation, the connector 10 may have applied a thermal insulation to prevent the connector 10 outer surfaces from coming into contact with other components of a larger system or device that operates near or in conjunction with the connector 10. The thermal insulation also protects the operability, reliability and user's safety. A thermal insulation may be manufactured from any known thermally resistant materials, such as plastics, rubber compounds or engineered materials. By way of example and not limitation silicon rubber may be used as an electrical insulator and a thermal insulator to cover connector 10 outer surfaces. Again referring to FIG. 2*c*, FIG. 5*a* and FIG. 5*b*, by way of example and not limitation a thermoplastic and associated metallic foil coated over the plastic may provide an outer electrical insulation, outer thermal insulation and a conductive inner channel 26 to provide a reliable electrical connection to the electrical circuit comprising the power source, channel 18, conductor 32, the ribbed troughs 20, the divisional set of carbon fiber 30 and ribbed protrusions 22.

As shown in FIG. 6*a*, the heater 34 may be terminated by connector 10*a*, 10*b* to each terminus respectively of the fiber tow 30*a*. Connector 10*a* will connect to a positive voltage potential in respect to connector 10*b*. As shown in FIG. 6*b*, two or more heater 34 may be connected in series. In any case lead lines 33 must be provided at each terminal end of the heater to connect to the input power source. As shown in FIG. 6*c*, two or more heater 34 may be connected in a parallel electrical connection. Additionally the heat may be regulated by a thermostatic device commercially and commonly available that would connect to a voltage or current controller connected to the connector 10*a*, 10*b* to limit the power into the heater 34 carbon fiber 30*a* tow. A thermostat 37 may be installed in the connector or in the heater 34 sheath. By way of example and not limitation 32 feet of 50K carbon fiber tow 30*a* yields approximately 165 degrees F. The temperature output decreases as the carbon fiber tow 30*a* length is increased or sections are added through a series connection. As in FIG. 6*c*, carbon fiber tow 30*a* sections can be added in parallel to maintain any temperature desired up to a maximum of the fiber carbon tow or the sheath temperature limitations.

Figure 7:
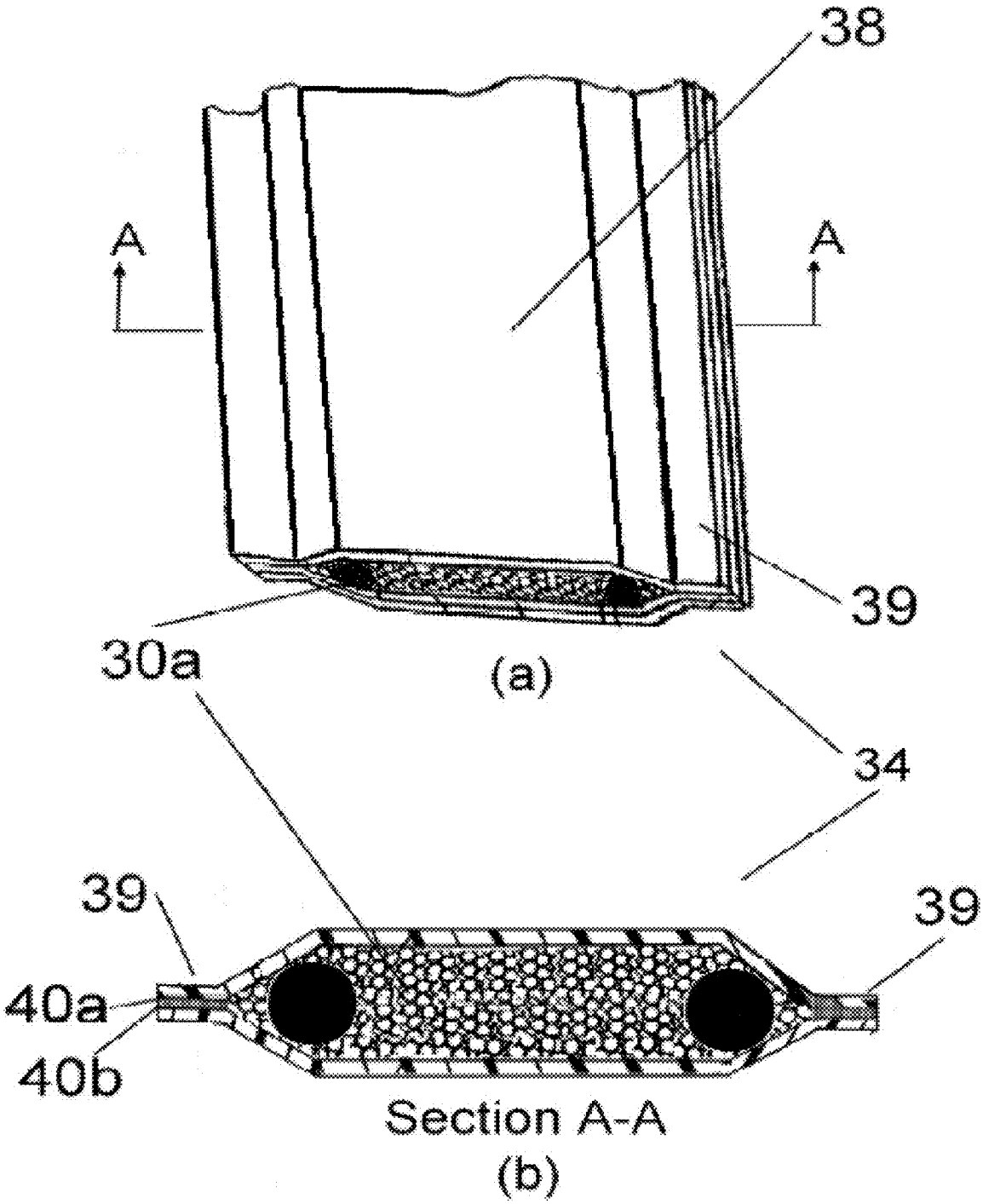
FIG. 7*a* illustrates a top view of a heater assembly in accordance with an embodiment of the present invention.
FIG. 7*b* illustrates a cross sectional view of a heater assembly in accordance with an embodiment of the present invention.

FIG. 7*a* illustrates the heater 34 covered by a sheath 38 of silicon material. The silicon utilized in FIG. 7*a* is a self-fusing silicone tape requiring no adhesive because it chemically bonds to itself upon contact at ends 39. Once the bonding is complete the heater is capable of operating in a temperature range of −65F. to 700F. The silicon tape also provides the added features of resisting ultraviolet radiation, most oils, salts, and corrosive chemicals. A silicon tape that operates satisfactorily as a sheath 38 is manufactured and sold by Midsun Specialty Products Inc. under the registered trademark Tommy Tape. FIG. 7*b* shows insulated lead lines 33 at terminal end of the heater, providing power and power returns for the input power source.

Unlike the prior art that requires an adhesive to bond to at least one surface of the carbon fiber tow (see, for example, U.S. Pat. No. 7,247, 822), the silicon tape does not require any adhesive to reliably fix the carbon fiber tow 30*a* into the sheath 38. Additionally, there is also no need to treat the sheath 38 with any fusing heat, since to create a reliable bond between the two silicon surfaces 40*a*, 40*b*, an applied pressure vulcanizes the silicon tape into essentially one material. The vulcanization creates a seal protecting the carbon fibers from invasive environmental contaminants. The silicon tape also withstands and degradation due to temperature cycling unlike polyester heater sheath materials that becomes brittle under many heating/cooling cycles and cannot reliably work when subjected to temperatures above 180F. degrees, and in fact shows signs of accelerated aging or complete failure above 350F. Using silicon tapes the heater 34 attains heats approaching 600F. with no visible signs of deterioration.

An embodiment of the invention herein includes heating element 34 utilizing the carbon fiber tow 30*a* and the connector 10 that includes the opposing upper and a lower portion wherein said upper portion includes a plurality of parallel ribbed troughs 20 and said lower portion includes plurality of parallel ribbed protrusions 22, and wherein the upper and lower portions of said surface engagingly fasten that portion of said tow 30*a* between the ribbed protrusions 22 and the ribbed troughs 20 to hold said fiber tow 30*a* in a fixed position, and further wherein the carbon fiber tow 30*a* is embedded in a sheath 38 comprised of a laminar silicon rubber material.

The heater sheath 38 laminar silicon rubber material has two opposing lengths with an upper surface and a lower surface that encapsulate the carbon fiber tow 30*a* by joining material along the end 39 or edge of the lower surface.

An embodiment of the invention herein also includes a method of assembling connector 10 for attaching an electrical power source to the conductive carbon fiber tow 30 including forming, as shown in FIG 1*a* through FIG. 1*c*, the substantially rectangular metal plate having surface 11 having the lower surface and an upper surface; forming on a left half portion of said plate lower surface the plurality of troughs 20 and forming on a right half portion of said plate lower surface the plurality of ribbed protrusions 22; bending said plate at substantially the mid section 9 between the left half portion and the right half portion substantially 180 degrees to create opposing mating portions wherein the plurality of troughs 20 are directly opposed to the plurality of ribbed protrusions 22.

As is now apparent from the foregoing, the connector 10 is completely mechanical in its construction and assembly and does not require ultrasound welding or any form of heat or adhesive bonding. The lack of any processes, except mechanical pressures, required to retain the carbon fiber 30 in the connector 10 eliminates manufacturing steps that limit the reliability of fiber connections at temperatures in excess of 400F. Therefore carbon fiber tows running in excess of 600 degrees F. will operate reliably in connector 10 as described.

The connector 10 is not limited for use with carbon fiber tow 30 solely. Such a cable may be in the form of the amorphous metal ribbons used in the heating industry. The connector 10, may also be used to terminate flat copper ribbon such as used in many industrial, commercial and consumer applications. Importantly, connector 10 can be used on any flat cable, especially where the use of any assembly process other than mechanical, is permitted.

While the foregoing invention has been described with reference to the above embodiments, additional modifications and changes can be made without departing from the spirit of the invention. Accordingly, such modifications and changes are considered to be within the scope of the appended claims.

We claim:

1. A connector for attaching an electrical power source to a conductive tow comprising: a flat metallic surface having an upper and a lower mating portion; said upper portion includes a plurality of parallel ribbed troughs and said lower portion includes plurality of parallel ribbed protrusions, wherein the upper and lower portions of said surface bend at substantially the mid section between the upper mating portion and the lower mating portion at substantially 180 degrees to create opposing mating portions that engagingly fasten, such that a portion of said tow between the ribbed protrusions and the ribbed troughs hold the portion of said tow in position.

2. The connector in claim 1, wherein the tow is made from carbon fiber strands.

3. The connector in claim 1, wherein the tow comprises a heating element.

4. The connector in claim 2, wherein the carbon fiber strands are held between the plurality of parallel ribbed protrusions and the plurality of parallel ribbed troughs.

5. The connector in claim 1, further including a clip that keeps the upper and lower portions of said surface engagingly fasten such that a portion of said carbon fiber strands between the ribbed protrusions and the ribbed troughs hold said fibers in position.

6. The connector in claim 2, wherein the electrical resistance across the connector is less than or equal to the resistance of an equal length of carbon fiber.

7. The connector in claim 2, wherein tips of the protrusions have a contact surface with a radius that assures that the carbon fiber strands are griped and not damaged.

8. The connector in claim 2, wherein a recess of the ribbed troughs have a contact surface with a radius that assures that the carbon fibers are griped and not damaged.

9. The connector in claim 3 is manufactured from one of a metal, or engineered material or plastic suitable for withstanding the operating temperature of the heater.

10. The connector in claim 1, wherein an electrical insulator covers one or more of the external surfaces of the connector.

11. The connector in claim 1, wherein a heat insulator covers one or more of the external surfaces of the connector.

12. The connector in claim 10, wherein silicon paint insulates one or more of the external surfaces.

13. The connector in claim 1, wherein the upper and a lower mating portion substantially opposing each other are manufactured by: forming a metal plate having a lower surface and an upper surface; forming on a left half portion of said metal plate lower surface a plurality of troughs; and forming on a fight half portion of said plate lower surface a plurality of fibbed protrusions; bending said plate at substantially the mid section between the left half portion and the right half portion at substantially 180 degrees to create opposing mating portions, and wherein the plurality of troughs are directly opposed to the plurality of ribbed protrusions.

14. The connector in claim 13, further manufactured by including gripping conductive carbon fiber strands between the plurality of troughs and the directly opposed plurality of fibbed protrusions.

15. The connector in claim 13, further manufactured by including attaching an electrical power source to a conductive tow.

16. The connector in claim 13, further manufactured by including attaching a connector to an opposite end of the carbon fiber tow.

17. The connector in claim 1, wherein the carbon fiber tow is embedded in a sheath comprised of a laminar silicon rubber material.

18. The connector in claim 17, wherein the sheath of the laminar silicon rubber has two opposing lengths with an upper surface and a lower surface that encapsulate the carbon fiber tow by joining material along the edge of the lower surface.

19. The connector in claim 17, wherein the connector further includes a strain relief to prevent the portion of the tow from damage.

* * * * *